US006173650B1

(12) United States Patent
Garvick et al.

(10) Patent No.: US 6,173,650 B1
(45) Date of Patent: Jan. 16, 2001

(54) MEMS EMERGETIC ACTUATOR WITH INTEGRATED SAFETY AND ARMING SYSTEM FOR A SLAPPER/EFI DETONATOR

(75) Inventors: Donald R. Garvick, Silver Spring, MD (US); Lawrence C. Fan, Vienna, VA (US); Bruce R. Kuester, Silver Spring; Gregory R. Birk, Columbia, both of MD (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/342,918

(22) Filed: Jun. 30, 1999

(51) Int. Cl.[7] ..... F42C 15/184

(52) U.S. Cl. ..... 102/202.5; 102/202.4; 102/204; 102/202.6; 102/254

(58) Field of Search ..... 102/202.5, 202.4, 102/204, 206, 254, 202.6

(56) References Cited

U.S. PATENT DOCUMENTS

| | | | | |
|---|---|---|---|---|
| H1366 | | 11/1994 | Bickes, Jr. et al. . | |
| 4,471,697 | * | 9/1984 | McCormick et al. | 102/202.14 |
| 4,592,280 | | 6/1986 | Shores . | |
| 4,770,096 | * | 9/1988 | Maruska et al. | 102/229 |
| 4,862,803 | | 9/1989 | Nerheim et al. . | |
| 5,088,413 | | 2/1992 | Huber et al. . | |
| 5,370,053 | | 12/1994 | Wiliams et al. . | |
| 5,431,104 | | 7/1995 | Barker . | |
| 5,621,183 | | 4/1997 | Bailey . | |
| 5,789,697 | * | 8/1998 | Engelke et al. | 102/202.5 |
| 5,824,910 | | 10/1998 | Last et al. . | |

OTHER PUBLICATIONS

"SLIGA Based Underwater Weapon Safety and Arming System" by L.Fan et al. Microsystem Technologies, vol. 4, Jul. 1998.

* cited by examiner

*Primary Examiner*—Charles T. Jordan
*Assistant Examiner*—Lulit Semunegus
(74) *Attorney, Agent, or Firm*—Mark Homer

(57) ABSTRACT

An EFI (exploding foil initiator) or slapper detonator, including a explodable foil (or bridge), a flyer plate and a barrel plate having a movable barrier to close a barrel in a safety mode and for opening the barrel in an arming mode, wherein the movable barrier slides from a closed (safety) position to an open (armed) position under the control of a MEMS (microelectromechanical system) energetic actuator. The slidable barrier is maintained in the closed position by one or more locking devices of the MEMS energetic actuator until predetermined stimuli are detected to cause the locking device(s) to release the slidable barrier, thereby arming the EFI or slapper detonator.

22 Claims, 3 Drawing Sheets

MEMS EMERGETIC ACTUATOR WITH INTEGRATED SAFETY AND ARMING SYSTEM FOR A SLAPPER/EFI DETONATOR

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

1. Field of the Invention

The present invention pertains to a slapper/EFI(Explosive Foil Initiator) detonator, and more particularly to a slapper/EFI detonator having a safety and arming slider barrier for a barrel integrated with a MEMS (microelectromechanical system) energetic actuator.

2. Background Art

Microelectromechanical devices (also called micromechanical devices or micromachines) are small (micron scale) machines that promise to miniaturize instrumentation in the same way microelectronics have miniaturized circuits. Microelectromechanical(MEM) devices have configurations analogous to conventional macroscale machinery.

The exploding foil initiator (EFI), also known as the slapper detonator was developed by the DOE National Laboratories (Sandia, Los Alamos, Lawrence Livermore) in the mid 1970's for unconventional weapon applications. A detonator is the heart of a system to set off explosive devices such as warheads, torpedoes and other devices, such as air bag inflators. Traditionally, a blasting cap or a hot bridge wire in contact with a relatively easily detonated primary explosive material is used to set off the ultimate secondary explosive material. These devices have minimum safety, since rather low level, spurious electrical currents can activate the blasting cap or bridge wire. U.S. Pat. No. 4,592,280 to Marvin W. Shores and entitled *Filter/Shield For Electro-Explosive Devices* describes an explosive device called a squib which utilizes such a bridge wire. See also U.S. Pat. No. 5,621,183 to Todd R. Bailey entitled *Initiator For an Air Bag Inflator.*

To overcome the above safety problem, the exploding bridge wire system was developed in which a large current is applied to a bridge wire, rapidly heating it and causing it to explode. In a further development, the exploding bridge wire was replaced with a slapper detonator which includes an exploding foil which forms part of a laminated printed circuit board type structure. When a large electrical current is passed through the foil, it rapidly explodes, or vaporizes, causing a flyer to be sheared from a plastic layer (disk) by a barrel positioned between the plastic layer and an explosive, and the flyer is directed through the barrel towards the explosive. When the flyer "slaps" against the explosive, the explosive is detonated. Slapper detonators are exemplified by U.S. Pat. No. 5,370,053 to Matthew R. Williams et al. entitled *Slapper Detonator*, U.S. Pat. No. 5,531,104 to James Barker entitled *Exploding Fail Initiator Using A Thermally Stable Secondary Explosive*; U.S. Statutory Invention Registration No. H1366 to Robert W. Bickes, Jr. et al. entitled *SCB Initiator*; and U.S. Pat. No. 4,862,803 to Eldon Nerheim et al. entitled *Integrated Silicon Secondary Explosive Detonator*. In order to avoid premature detonation of the explosive by the flyer U.S. Pat. No. 5,088,413 to Klaus B Huber et al. entitled *Method and Apparatus For Safe Transport Handling Arming And firing Of Performing Guns Using A Bubble Activated Detonator* contemplates utilizing a safety barrier apparatus, for use with a prior art EFI detonator, the safety barrier being disposed in the barrel of the EFI detonator and providing a barrier whereby the flyer impacts the barrier in the barrel when a safe-arm feature is needed to preclude premature detonation of the explosive.

A problem with the above mentioned safety barrier is that it must be manually inserted into the barrel to engage the safety mode and manually removed for arming. Accordingly, the detonator is subject to premature detonation at any time after the safety barrier is removed.

SUMMARY OF THE INVENTION accordingly, it is a primary object of the present invention to provide an alternative EFI or slapper detonator which inherently includes all the advantages associated with EFI or slapper detonators, but which overcomes the disadvantages of known EFI or slapper detonators.

It is another object of the present invention to provide an EFI or slapper detonator having an integrated safety and arming system for closing or opening a barrel of the EFI or slapper detonator.

It is also an object of the present invention to provide an EFI or slapper detonator integrated with a MEMS energetic actuator to provide a safety and arming feature for closing or opening a barrel of the EFI or slapper detonator.

It is an additional object of the present invention to provide an EFI or slapper detonator integrated with a slider barrier which closes or opens a barrel of the EFI or slapper detonator to provide a safety and arming feature for the EFI or slapper detonator.

It is a further object of the present invention to provide an EFI or slapper detonator integrated with a MEMS energetic actuator for controlling a slider barrier which closes or opens a barrel of the EFI or slapper detonator to provide a safety and arming feature for the EFI or slapper detonator.

These and other objects of the invention are accomplished by designing and providing an EFI or slapper detonator, including a explodable foil (or bridge), a flyer plate and a barrel, with a movable barrier to close the barrel in a safety mode and for opening the barrel in an arming mode, wherein the movable barrier slides from a closed (safety) position to an open (armed) position under the control of a MEMS energetic actuator. The slidable barrier is maintained in the closed position by one or more locking devices of the MEMS energetic actuator until predetermined conditions are met to cause the locking device(s) to release the slidable barrier, thereby arming the EFI or slapper detonator.

BRIEF DESCRIPTION OF THE DRAWINGS

A more complete appreciation of the present invention, any many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1B:
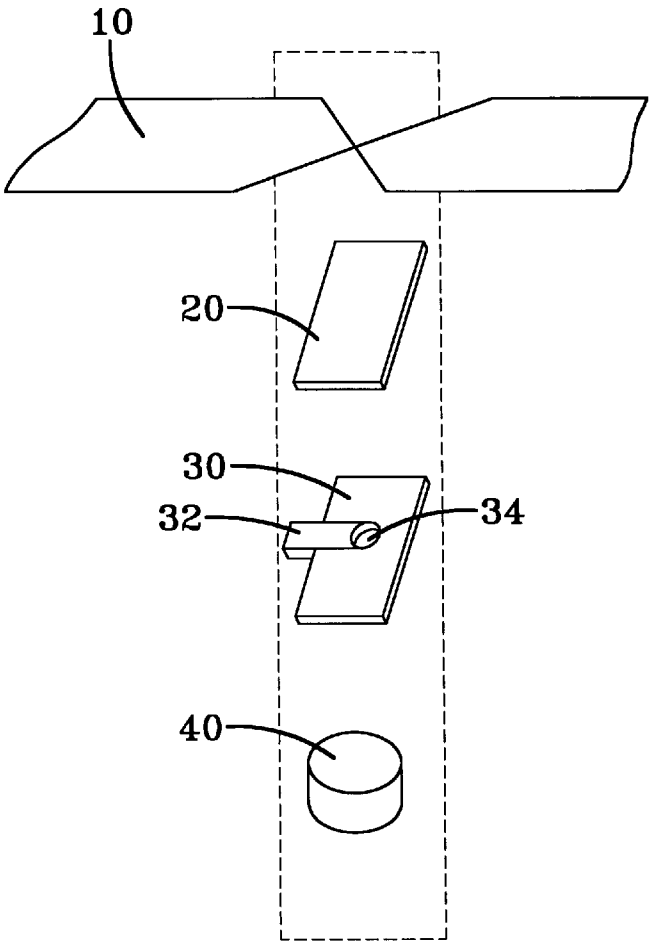
FIGS. 1A and 1B illustrates exploded views of an EFI or slapper detonator having a barrel plate with a slidable barrier for closing and opening a barrel of the barrel plate in a safety mode and an armed mode, respectively, in accordance with a first embodiment of the present invention.
Figure 1A:
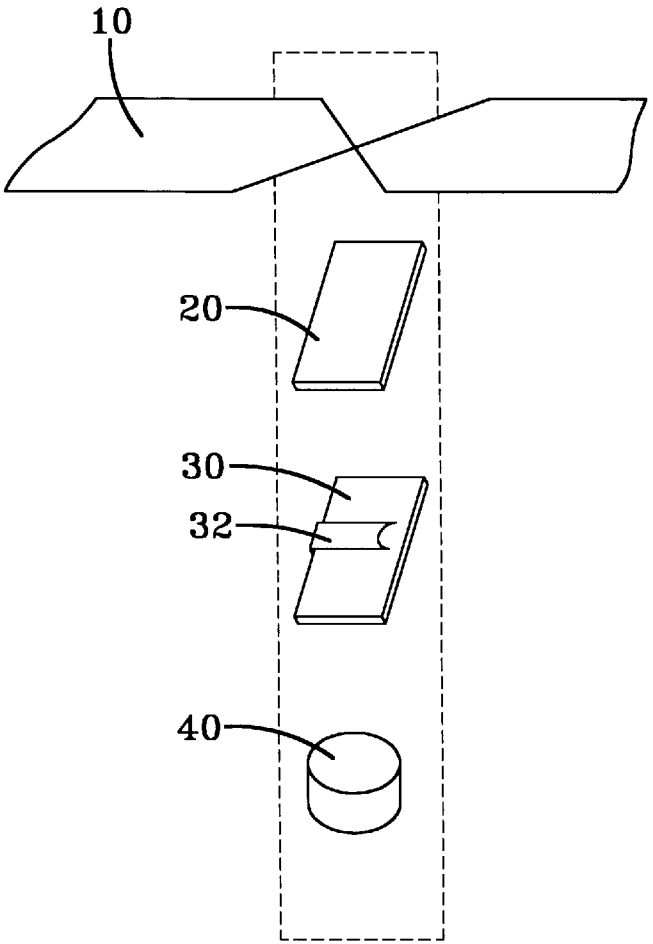

FIGS. 1A and 1B depict an EFI or slapper detonator (referred to hereafter as slapper detonator) modified, according to the present invention, to have a safety and arming barrel plate 30. In FIGS. 1A and 1B the slapper detonator includes a bridge, or explodable foil, 10, a flyer plate 20, the safety and arming barrel plate 30 and a high explosive pellet 40. Barrel plate 30 includes a slidable barrier 32 which is shown in FIG. 1A to be in the safety position to close a barrel plate 30. In FIG. 1B the slidable barrier 32 is shown in the arming position to open barrel 34.

Referring to FIG. 1B, foil 10 is comprised of a low impedance copper strip that has an area of reduced width over barrel 34. When a high voltage, greater than 500 volts DC (direct current) is suddenly (<1 sec) is applied to foil 10, current density at the narrow area of the copper strip increases and heat is generated. At this time a hot high pressure gas (plasma) is generated pushing flyer plate 20 against barrel pate 30. A portion, i.e. a flyer or slapper, of flyer plate 20 is sheared off by barrel 34 of barrel plate 30, passes through barrel 34 and strikes high pellet 40 with enough kinetic energy ($\frac{1}{2}$ $m^{v^2}$) to detonate high explosive pellet 40.

Figure 2B:
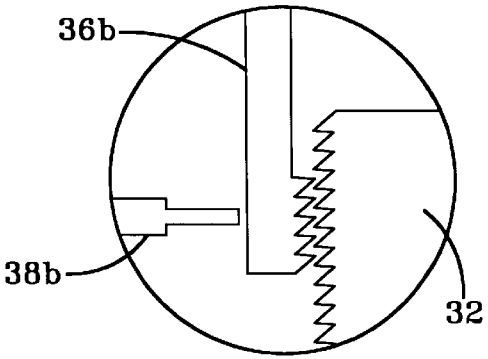
FIG. 2B and 2C are close-up views of portions of FIG. 2A.
Figure 2C:
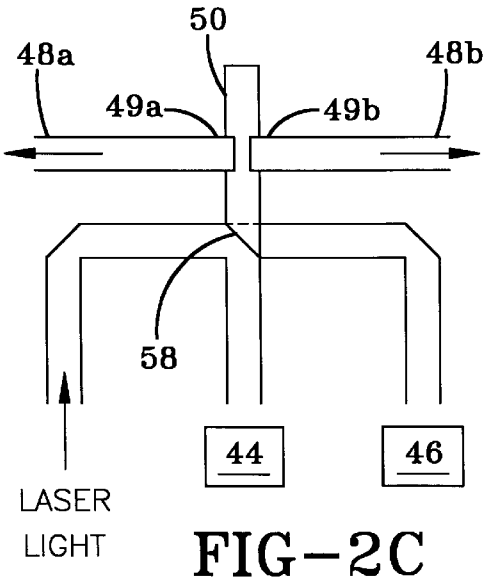
Figure 2A:
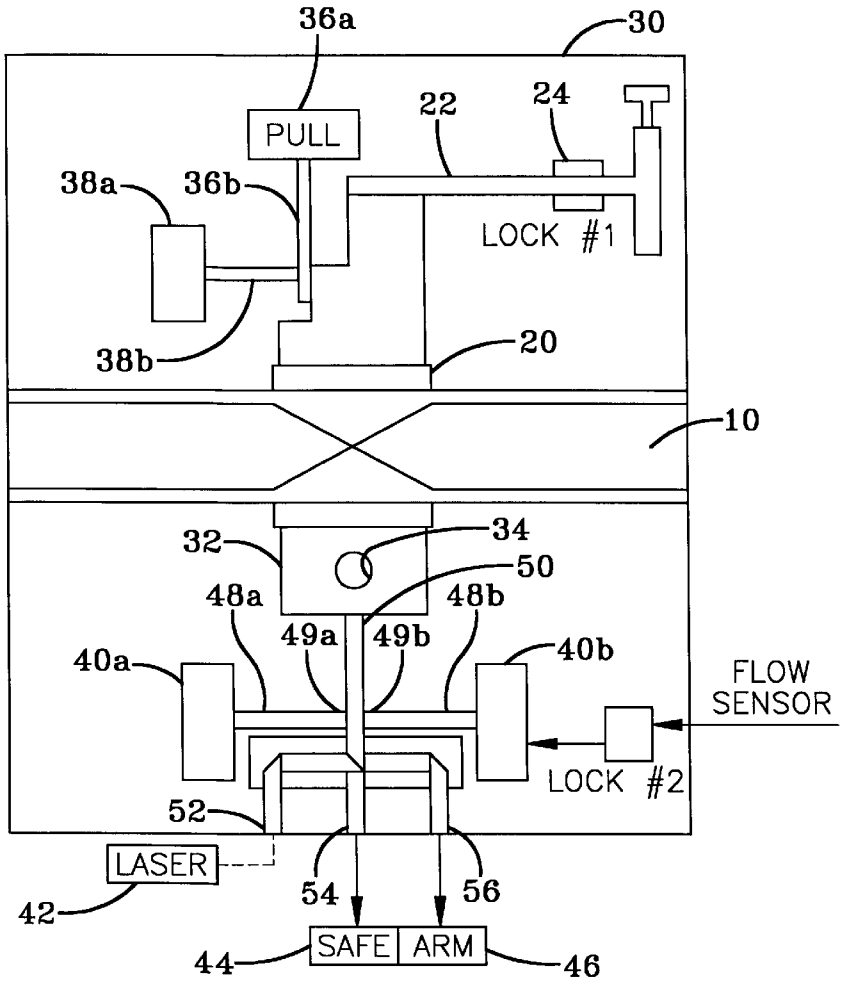
FIG. 2A is a top view of the EFI or slapper detonator integrated with a MEMS energetic actuator to provide a safety and arming feature for closing or opening a barrel of the EFI or slapper detonator, in accordance with a second embodiment of the present invention.
Figure 3B:
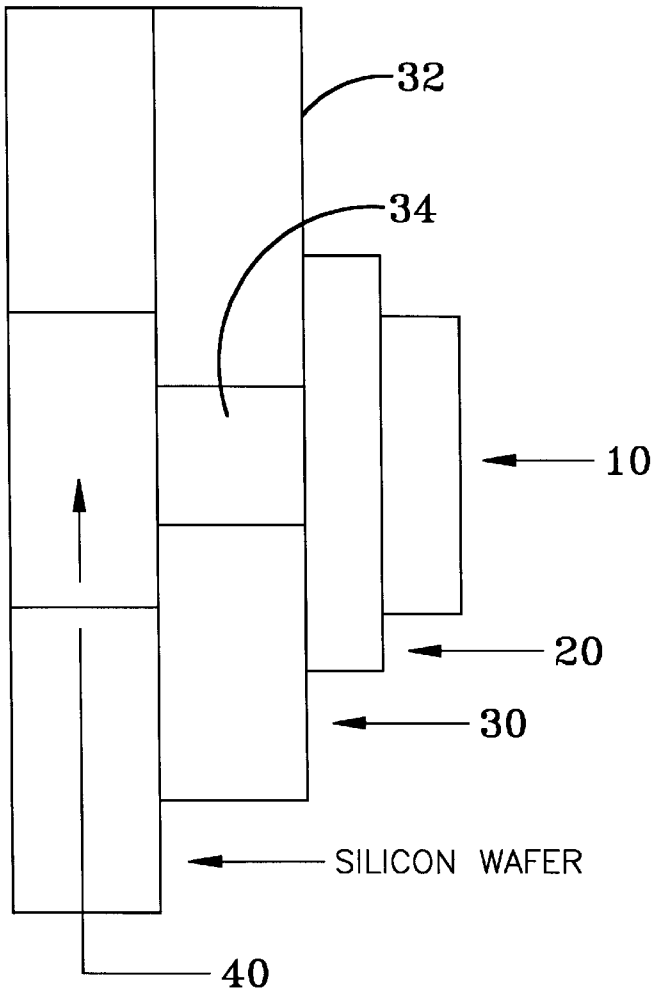
FIG. 3A and 3B are exemplary side views of the EFI or slapper detonator integrated with a MEMS energetic actuator illustrating the closing or opening a barrel of the EFI or slapper detonator.

Referring to FIG. 2A, the slapper detonator integrated with a MEMS energetic actuator to provide a safety and arming feature for closing or opening a barrel of the EFI or slapper detonator, is shown. The slapper detonator includes an explodable foil 10, a flyer plate 20 and the safety and arming barrel plate 30. Also, slapper detonator includes a slidable barrier 32 having the barrel 34 integrated therein. Slider barrier 32 is moved from the safety position (FIG. 3A) to the arming position (FIG. 3B) by the MEMS energetic actuators including a pull 36*a*, engaging unit 38*a*, Lock #1, Lock #2, pawls 40*a* and 40*b* and an optical system.

Pull 36*a* has an pull arm 36*b*, which is preferably a thermal actuator, that is engaged (see FIG. 2B) with slider barrier 32 by engaging unit 38*a* and engagement arm 38*b*, which also is preferably a thermal actuator, in response to predetermine condition, such as a circuit controlled by a predetermined stimulus, such as a detected ambient pressure or a predetermined timing operation. Thermal actuators are well known. Lock #1 is responsive to hydrostatic pressure to release slider barrier 32, thereby permitting pull 36*a* to move slider barrier 32 in order to slide barrel 34 into the fully armed position below foil 10 and flyer plate 20. Since pull arm 36*b* uses a thermal actuator, then the distance of the pull is short. Accordingly, pull 36*a* and engaging unit 38*a* are cyclically controlled to slide slider barrier 32 in incremental steps to the fully armed position. FIG. 2B shows a plurality of teeth on pull arm 36*b* which will engage, under the control of engagement arm 38*b*, a plurality of teeth on slidable barrier 32.

Lock #1 may be made as described in U.S. Pat. No. 5,824,910 to Howard R. Last et al. and entitled *Miniature Hydrostat Fabricated Using Multiple Microelectromechanical Processes*, incorporated herein by reference. Briefly, Lock #1 uses a pivotal beam 22 to lock slider barrier 32 in the safe position. There is an ambient fluid in a chamber (not shown) beneath a diaphragm 24 which causes diaphragm 24 to rise due to increased pressure. Alternatively, the fluid could be a thermally expandable fluid which expands in response to an applied an electrical current, or other heating source, which is controlled by a predetermined stimulus, e.g., timing, velocity detection, altitude, depth, etc. The stimulus can be as varied as there are numerous uses for the slapper detonator.

Figure 3A:
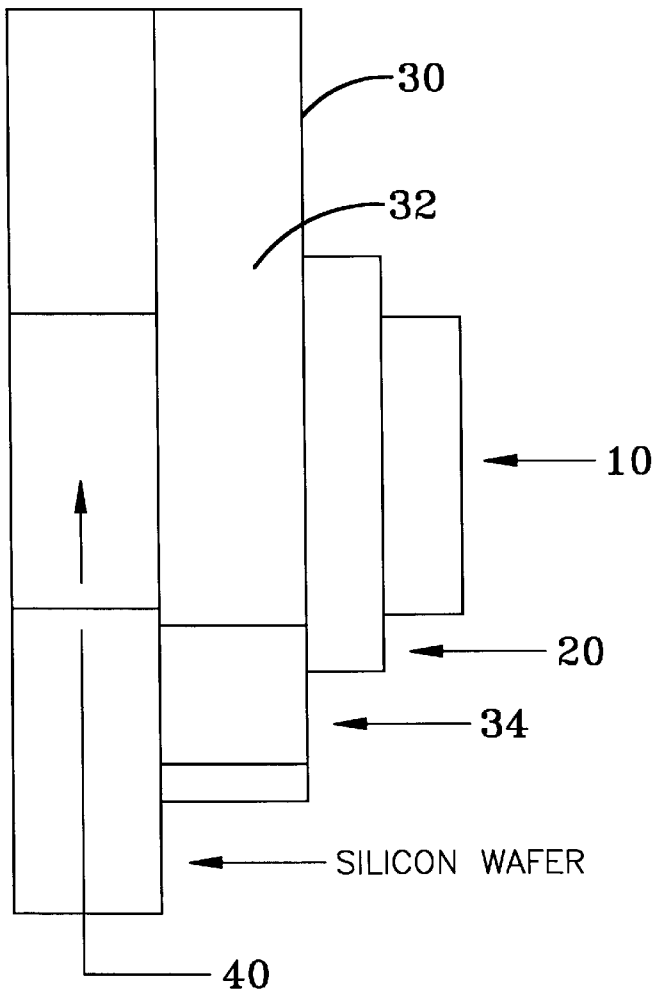

The MEMS energetic actuator is capable of producing movement, for example, in the range of 100 $\mu$m ($100\times10^{-6}$). This is sufficient movement to fully open a closed barrel. Thus when the MEMS device has produced a mechanical movement in the order of 100 $\mu$m, the slapper detonator can be armed and activated. Referring to FIG. 3A, when the barrel 34 is in the closed position (Safe Mode), the explosive pellet 40 will not detonate even if the firing voltage is applied to foil 10. With regard to FIG. 3B, when the barrel 34 is open (Armed Mode) the device will operate as a normal slapper detonator. The slider barrier 32 is made of metal (nickel) capable of absorbing the impact of a flyer to prevent premature detonation of the slapper detonator.

An optical system, such as a laser, is provided to determine the position of the slider barrier 32 and barrel 34. By collecting light using, for example, fiber optics, the light is focused on a mirror attached to the slider barrier 32. Receiving fiber optics is positioned to capture the reflected light when the slider barrier is in one of the closed or open positions to detect whether the slider barrier is in one of the safety mode or armed mode. Thus, by observing the output of the fiber optics the position of the slider barrier can be determined and the safe mode or armed mode indicated. To this end, a Lock #2 is responsive to a predetermined stimulus, e.g., a timing condition or an environmental condition, identified in FIG. 2A as the flow sensor input to Lock #2, which may be the same stimulus as the stimulus for Lock #1, but is preferably a different stimulus for added safety. The timing or environmental condition can be as varied as there are numerous uses for the slapper detonator. For example, the timing condition may be set to indicate when a launched warhead is a safe distance from the launch pad. An example of an environmental condition may be based on an obtained velocity.

Referring further to FIGS. 2A and 2C, when Lock #2 is activated by the flow sensor signal in response to a preset condition, rachet pawls 40*a* and 40*b* are activated to disengage locking bars 48*a* and 48*b* from catches 49*a* and 49*b* in light deflector arm 50 attached to slider barrier 32. In the position as shown in FIG. 2A, one end of light deflector arm 50 reflects light from laser 42, via optical fiber 52, into optical fiber 44 thereby causing indicator 44 to provide an indication that the slapper detonator is in the safety mode. When Lock #2 is activated and when Lock #1 is activated, slider barrier 32 is pulled into the arming position by pull 36*a*. At this time, the one end, i.e., distal end, of light deflector arm 50 is no longer in position to deflect the light from laser 42, thus the light is then passed through optical fiber 56 causing indicator 46 to provide an indication that the slapper detonator is in the armed mode. Note that a mirror 58 may be positioned at an angle of 45 degrees on the distal end of light deflector arm 50 to deflect the light into optical fiber 54.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense. While the foregoing has been directed to the preferred embodiment, there are variations and changes in the embodiments of the present disclosure which will be readily apparent to those of ordinary skill in the art. The aim and thrust of the appended claims is to cover variations that fall within the true spirit and scope of the disclosed invention, and the claims thus set forth the present invention.

What is claimed is:

1. A slapper detonator comprising:

a bridge;

a flyer plate adjacent said bridge;

a barrel plate adjacent said flyer plate, said barrel plate comprising;

a slidable barrier and a barrel, said barrel being closed when said slidable barrier is in a first position and said barrel being open when said slidable barrier is in a second position; and an explosive pellet.

2. The slapper detonator as set forth in claim 1, wherein said bridge is comprised of an explodable foil.

3. The slapper detonator as set forth in claim 1, wherein said slidable barrier is comprised of metal.

4. The slapper detonator as set forth in claim 1, wherein said slidable barrier is comprised of nickel.

5. The slapper detonator as set forth in claim 1, wherein said barrier is formed in said slidable barrier.

6. The slapper detonator as set forth in claim 5, wherein said barrel plate further comprises microelectromechanical energetic actuators for controlling movement of said slidable barrier from said first position to said second position, said slapper detonator being in a safe mode when said slidable barrier is in said first position and being in an armed mode when said slidable barrier is in said second position.

7. The slapper detonator as set forth in claim 6, wherein said microelectromechanical energetic actuators comprise:

a first lock and a second lock for holding said slidable barrier in said first position, said first and second locks being responsive, respectively, to a first predetermined stimulus and a second predetermined stimulus to release said slidable barrier;

a pull having a pull arm for moving said slidable barrier from said first position to said second position when said slidable barrier is released;

a engaging unit having an engagement arm for controlling said pull arm of said pull to engage said slidable barrier;

a light deflector arm attached to said slidable barrier, said light deflector arm having a mirror angularly attached to its distal end and a pair of catches disposed near said distal end;

first and second rachet pawls having locking bars inserted into said catches for holding said slidable barrier in said first position, said first and second rachet pawls being responsive to said second lock for retracting said locking bars to release said slidable barrier; and optical means for focusing a light on said mirror to provide a visual indication that said slidable barrier is in said first position.

8. The slapper detonator as set forth in claim 7, wherein said engagement arm and said pull arm are thermal actuators.

9. The slapper detonator as set forth in claim 7, wherein said first lock is a hydrostat and said first stimulus is pressure generated by an ambient fluid.

10. The slapper detonator as set forth in claim 7, wherein said second stimulus is a detected velocity.

11. The slapper detonator as set forth in claim 7, wherein said optical means comprises:

a laser for providing said light;

a first optical fiber for guiding said light towards said mirror;

a second optical fiber for receiving said light when said mirror deflects said light when said slidable barrier is in said first position; and a first indicator for receiving said light via said second optical fiber to indicate that said slapper detonator is in said safe mode.

12. The slapper detonator as set forth in claim 11, wherein said optical means further comprises:

a third optical fiber for receiving said light when said mirror fails to deflect said light when said slider barrier is moved to said second position; and a second indicator for receiving said light via said third optical fiber to indicate that said slapper detonator is in said armed mode.

13. An exploding foil initiator comprising:

a copper foil;

a flyer plate adjacent said copper foil;

a barrel plate adjacent said flyer plate, said barrel plate comprising:

a slidable barrier having barrel therein, said barrel being closed when said slidable barrier is in a first position, and said barrel being open when said slidable barrier is in a second position; and a explosive pellet.

14. The exploding foil initiator as set forth in claim 13, wherein said slidable barrier is comprised of nickel.

15. The exploding foil initiator as set forth in claim 13, wherein said barrel plate further comprises microelectromechanical energetic actuators for controlling movement of said slidable barrier from said first position to said second position, said exploding foil initiator being in a safe mode when said slidable barrier is in said first position and being in an armed mode when said slidable barrier is in said second position.

16. The exploding foil initiator as set forth in claim 15, wherein said microelectromechanical energetic actuators comprise:

a first lock and a second lock for holding said slidable barrier in said first position, said first and second locks being responsive, respectively, to a first predetermined stimulus and a second predetermined stimulus to release said slidable barrier;

a pull having a pull arm for moving said slidable barrier from said first position to said second position when said slidable barrier is released;

a engaging unit having an engagement arm for controlling said pull arm of said pull to engage said slidable barrier;

a light deflector arm attached to said slidable barrier, said light deflector arm having a mirror angularly attached to its distal end and a pair of catches disposed near said distal end;

first and second rachet pawls having locking bars inserted into said catches for holding said slidable barrier in said first position, said first and second rachet pawls being responsive to said second lock for retracting said locking bars to release said slidable barrier; and optical means for focusing a light on said mirror to provide a visual indication that said slidable barrier is in said first position.

17. The exploding foil initiator as set forth in claim 16, wherein said optical means comprises:

a laser for providing said light;

a first optical fiber for guiding said light towards said mirror;

a second optical fiber for receiving said light when said mirror deflects said light when said slidable barrier is in said first position; and a first indicator for receiving said light via said second optical fiber to indicate that said exploding foil initiator is in said safe mode.

18. The exploding foil initiator as set forth in claim 17, wherein said optical means further comprises:

a third optical fiber for receiving said light when said mirror fails to deflect said light when said slider barrier is moved to said second position; and a second indicator for receiving said light via said third optical fiber to indicate that said exploding foil initiator is in said armed mode.

19. The exploding foil initiator as set forth in claim 16, wherein said engagement arm and said pull arm are thermal actuators.

20. The exploding foil initiator as set forth in claim 16, wherein said first lock is a hydrostat and said first stimulus is pressure generated by an ambient fluid.

21. The exploding foil initiator as set forth in claim 16, wherein said second stimulus is a detected velocity.

22. The exploding foil initiator as set forth in claim 16, wherein said second stimulus is a predetermined time period.

* * * * *